United States Patent [19]

Koshimaru et al.

[11] 4,342,213

[45] Aug. 3, 1982

[54] CLOSED CHAMBER EXTRUSION METHOD AND APPARATUS FOR SHAPING OF METAL ROD INTO TULIP-SHAPED PART

[75] Inventors: Hajime Koshimaru, Machida; Shoju Ishii, Tokyo, both of Japan

[73] Assignee: Nissan Motor Co., Ltd., Yokohama, Japan

[21] Appl. No.: 222,393

[22] Filed: Jan. 5, 1981

[30] Foreign Application Priority Data

Jan. 17, 1980 [JP] Japan ..... 55-3784

[51] Int. Cl.[3] ..... B21D 22/00

[52] U.S. Cl. ..... 72/358; 72/356

[58] Field of Search ..... 72/354, 356, 358, 377, 72/359, 360

[56] References Cited

U.S. PATENT DOCUMENTS

| | | | |
|---|---|---|---|
| 3,893,325 | 7/1975 | Soto | 72/354 X |
| 3,974,677 | 8/1976 | Castellani | 72/356 |
| 4,094,183 | 6/1978 | Meltler | 72/356 |
| 4,287,747 | 9/1981 | Koshimara | 72/358 |

FOREIGN PATENT DOCUMENTS

| | | |
|---|---|---|
| 2022521 | 6/1969 | Fed. Rep. of Germany . |
| 2261081 | 2/1974 | France . |
| 2431333 | 7/1979 | France . |

*Primary Examiner*—Leon Gilden

*Attorney, Agent, or Firm*—Thompson, Birch, Gauthier & Samuels

[57] ABSTRACT

A tulip-shaped metal part such as a yoke component of a tri-port type constant velocity universal joint is manufactured by single-stage closed chamber extrusion of a solid cylindrical metal rod. The metal rod is inserted into two opposingly engaged dies to protrude into a space defined in the dies and is axially pressed against an impressed surface to cause gradual and continuous cleavage of the rod into three branched portions, which are forced into three chambers arranged and shaped like three petal-like arms of the desired tulip-shaped metal part. The branched portions of the metal material are extruded within the three chambers in directions parallel to the direction of the pressing force exerted on the metal rod, with continued application of a back pressure in opposition to the extruded portions of the metal material to shape the ends of the petal-like arms during the extrusion process.

9 Claims, 25 Drawing Figures

CLOSED CHAMBER EXTRUSION METHOD AND APPARATUS FOR SHAPING OF METAL ROD INTO TULIP-SHAPED PART

BACKGROUND OF THE INVENTION

This invention relates to a method of manufacturing a metal part having three petal-like arms extending from one end of a solid cylinder, such as a tulip-shaped component of a tri-port type constant velocity universal joint in an automobile drive shaft, by closed chamber extrusion of a cylindrical rod and an apparatus for performing this closed chamber extrusion method.

In tri-port type constant velocity universal joints for automobile drive shafts, which are employed chiefly in front-engine front wheel drive cars, an important component serving as a sort of yoke is a tulip-shaped part that has three petal-like prongs or arms extending from one end of a solid cylinder in a circumferentially equally spaced arrangement. In a root portion, the three arms extend obliquely outwardly with respect to the center axis of the solid cylinder, but in the remaining portion they extend parallel to the center axis of the cylinder. The axially extending portion of each arm has the shape of a part of a cylindrical wall and is larger in width than the root portion. The material of this tulip-shaped part is a high tensile steel such as a chromium-molybdenum steel. Because of the intricateness of the overall configuration and the difference in width and hence in sectional area between the root portion and the axially extending portion of each arm, this tulip-shaped part can hardly be manufactured by an ordinary forging method.

Usually, the tulip-shaped part is manufactured by initially shaping a metal plate into a bell-shaped rough form by hot forging and then cutting three axially elongate slots in the cylindrical wall of the bell-shaped workpiece at circumferentially equal distances by means of a milling cutter, for example as disclosed in U.S. Pat. No. 3,805,653. However, this process is time-consuming and suffers a considerable loss of material.

Japanese Patent Application Primary Publication No. 54(1979)-81150 proposes to manufacture the tulip-shaped part through the steps of initially forming three axial grooves on the periphery of a cylindrical material by means of an extrusion machine fitted with die inserts for grooving, then machining the inside of the grooved cylinder to obtain a roughly tulip-shaped part and finally machining the outer surfaces and tip portions of the three arms. This process requires many machining operations with a considerable loss of material and can hardly be expected to bring about an appreciable improvement in productivity. Moreover, the repeated machining operations will possibly be detrimental to the physical strength of the finished product.

British Patent No. 1,474,876 proposes to manufacture the tulip-shaped part by a multi-stage die forging process using differently designed dies at the respective stages, supplemented by a relatively simple machining step. Although the loss of material is reduced, this process is quite low in its rate of production.

Meanwhile, it has been proposed to manufacture metal parts of rather intricate shapes by a sort of die forging process, wherein a portion of a cylindrical material is extruded into a closed chamber of an elongate shape defined in an assembly of two die blocks, for example in Japanese Utility Model Application No. 43(1968)-30038. However, it is believed to be quite difficult to manufacture the above described tulip-shaped part by this forging-extruding method.

SUMMARY OF THE INVENTION

It is an object of the present invention to provide a method of manufacturing a tulip-shaped metal part having three petal-like arms arranged circumferentially and spaced at equal angular intervals, such as a yoke component of a tri-port constant velocity universal joint, from a solid rod of a metal material by a closed chamber extrusion technique, which method is completed simply in a single stage, and can give an accurately shaped and flawless product with practically no loss of material. More particularly, the three arms of the metal part manufactured by this method extend from one end of a solid cylinder obliquely outwardly with respect to the longitudinal axis of the solid cylinder in their root portion and parallel to the longitudinal axis in the remaining region.

It is another object of the invention to provide an apparatus to perform a closed chamber extrusion method according to the invention.

A manufacturing method according to the invention utilizes two opposingly engaged and firmly clamped dies. A solid cylindrical rod of a forgeable metal material is inserted into a guide hole formed in the first die to allow the rod to longitudinally protrude into a central space defined in the engaged dies until one end of the rod collides against an impression formed on a surface in the second die. Then, a compression force is exerted on the rod from the other end thereof by using a punch inserted into the guide hole to axially press the rod against the impression to thereby cause the rod to gradually and continuously cleave into three branched portions which extend obliquely outwardly with respect to the axis of the rod and are spaced circumferentially at equal angular intervals. The exertion of the axial compression force on the partially cleaved rod is continued to thereby extrude the three branched portions, respectively, into three chambers which are defined in the second die in a circumferential arrangement at equal angular intervals and conjoin the central space. Each of these three chambers extends parallel to the longitudinal axis of the aforementioned guide hole, and extends parallel to the direction of pressing the metal material rod, and conforms in cross-sectional shape to the axially extending portion of each arm of the tulip-shaped metal part to be manufactured. Inserted into the three chambers from the unengaged end of the second die is a counterpunch having three elongate leg portions which are arranged circumferentially and spaced at equal angular intervals and so shaped as to slidably fit into the three chambers, respectively. The inserted counterpunch is maintained in a predetermined position with exertion of a back pressure thereon, while the exertion of the axial compression force on the partially cleaved rod is further continued until the cleaved and deformed metal completely fills the central space and the three chambers in the engaged dies and comes into contact with the inserted ends of the respective leg portions of the counterpunch. Thereafter, the exertion of the axial compression force on the partially cleaved rod is still further continued, with continued exertion of a back pressure on the counterpunch, to further extrude the metal material into the three chambers and force the counterpunch to gradually retract from the predetermined position against the back pressure, until the metal material extruded in the three chambers in the direction parallel to the pressing direction reaches a predetermined length.

This method comprises several steps as stated above, but actually all steps are performed continuously and almost simultaneously and can be completed in a very short time, such as about 10 seconds, without the need of parting the two dies or altering the punches before knock-out of the shaped metal part. Therefore, this method is a true single-stage process that enables industrial production of the tulip-shaped metal parts at a remarkably enhanced rate of production. Furthermore, this method brings about a great reduction of the material cost because this method does not include any milling or other kind of cutting operation and, hence, there is no need of affording the starting material with finishing allowance. Moreover, it is possible to manufacture the tulip-shaped metal parts with sufficiently high accuracy even when the arms of the tulip-shaped metal parts have a considerably large upset ratio (the ratio of the cross-sectional area in the yoke portion to that in the root portion), so that there is little need of subjecting the extruded parts to a trimming operation.

Essentially, a closed chamber extrusion apparatus according to the invention is an assembly including the first and second dies and the counterpunch mentioned in the above statement of the manufacturing method. The press machine and the punch to press the rod-shaped material are of conventional types. The most preferable configurations of the respective elements of the apparatus are as described hereinafter with reference to the drawing figures.

DESCRIPTION OF THE PREFERRED EMBODIMENTS

FIGS. 1–4 show a tulip-shaped part as a component of a tri-port type constant velocity universal joint for an automobile drive shaft. At present, this is the most important example of tulip-shaped metal parts that can be manufactured by a closed chamber extrusion method according to the invention.

Figure 2:
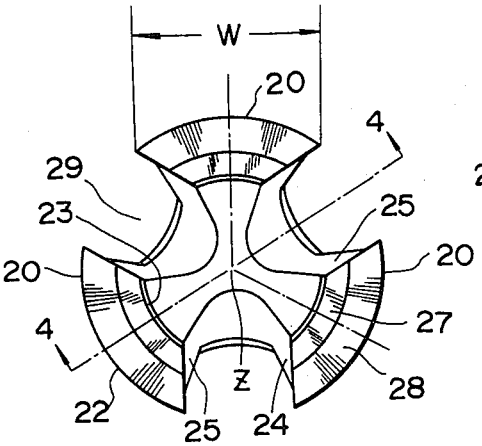
FIGS. 2 and 3 show the tulip-shaped part of FIG. 1 in a top plan view and in an elevational view, respectively.
Figure 1:
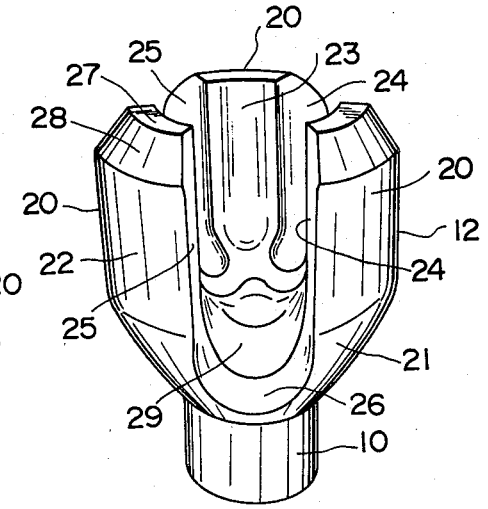
FIG. 1 is a perspective view of a tulip-shaped part of a tri-port type constant velocity universal joint manufactured by a method according to the invention.
Figure 3:
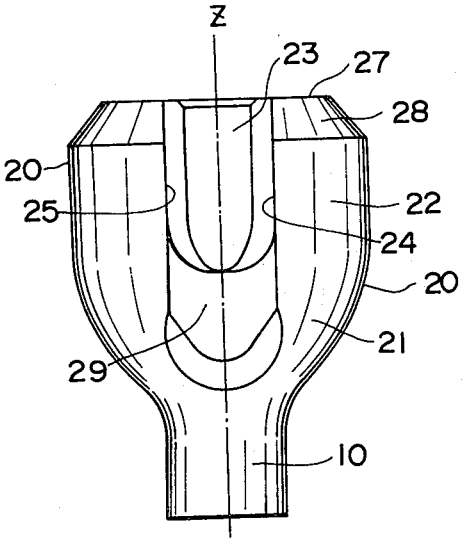
Figure 4:
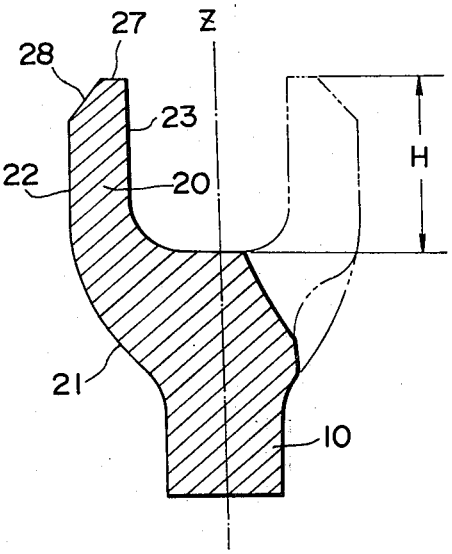
FIG. 4 is a sectional view taken along the line 4—4 of FIG. 2.

The illustrated tulip-shaped part has a shaft portion 10 in the form of a solid cylinder relatively small in diameter and a yoke portion 12 having three petal-like arms 20 extending generally upwards from the upper end of the shaft portion 10. The three arms 20 are spaced circumferentially at equal intervals of 120°. In the root portion, each arm 20 extends obliquely outwardly with respect to the longitudinal axis Z of the shaft portion 10 to have an upwardly diverging conical surface 21 on the outer side. The remaining portion of each arm 20 extends upwardly parallel to the axis Z and takes the form of a part of a hollow cylinder (suppositional) coaxial with the shaft portion 10. Accordingly, each arm 20 has a cylindrical outer surface 22 far larger in radius than the shaft portion 10 and a cylindrical inner surface 23 also larger in radius than the shaft portion 10. In the circumferential directions, each arm 20 is terminated by two flat surfaces 24 and 25, both parallel to the axis Z, so that the opposing side faces 24 and 25 of two adjacent arms 20 are parallel to each other. In the conical root portion of the arms 20, the opposing two side surfaces 24 and 25 are interconnected by an arched surface 26. As can be seen in FIG. 2, the horizontal width of each arm 20 becomes smaller in the obliquely extending root portion. Since the three arms 20 are all identical in shape and dimensions and arranged symmetrically with respect to the center axis Z, the tulip-shaped part can be regarded as having three identical vertical slots 29 cut in a suppositional cylindrical wall.

The upper end of each arm 20 is a flat surface 27 perpendicularly intersecting the flat side surfaces 24, 25 and the cylindrical inner surface 23. The cylindrical outer surface 22 of each arm 20 does not extend to the upper end face 27, but an upwardly converging conical surface 28 intervenes between the cylindrical outer surface 22 and the horizontal upper end surface 27, so that the yoke portion 12 of this tulip-shaped part seems to be chamfered along the circumferential tip edges on the outer side.

Figure 5:
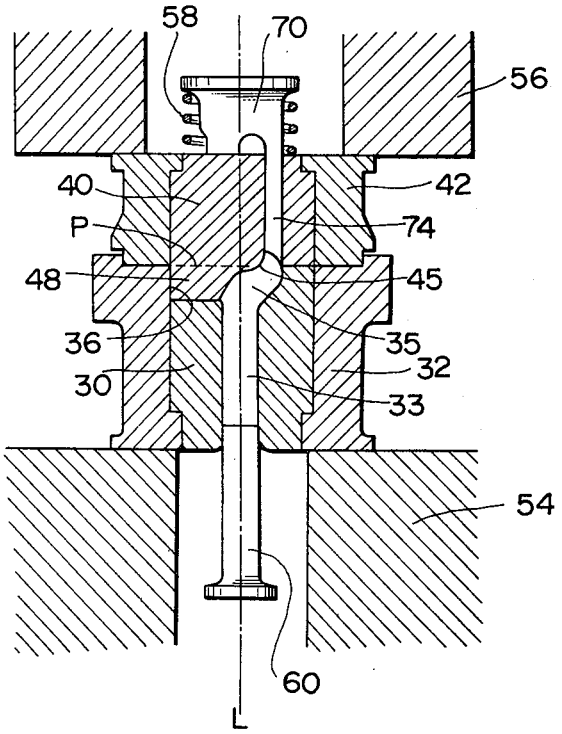
FIG. 5 is a longitudinal sectional view of a closed chamber extrusion apparatus according to the invention.
Figure 7:
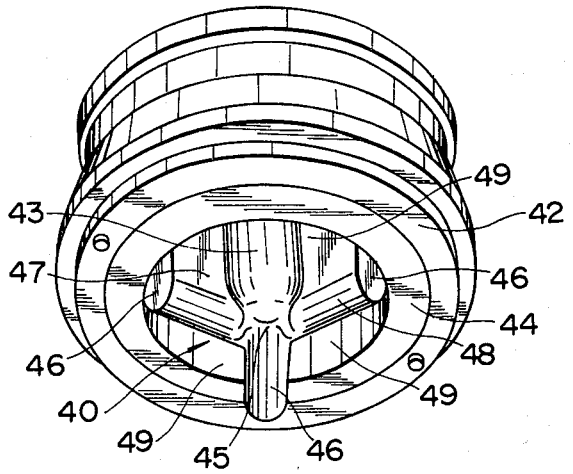
FIGS. 6 and 7 are perspective views of lower and upper dies, respectively, included in the apparatus of FIG. 5.
Figure 8:
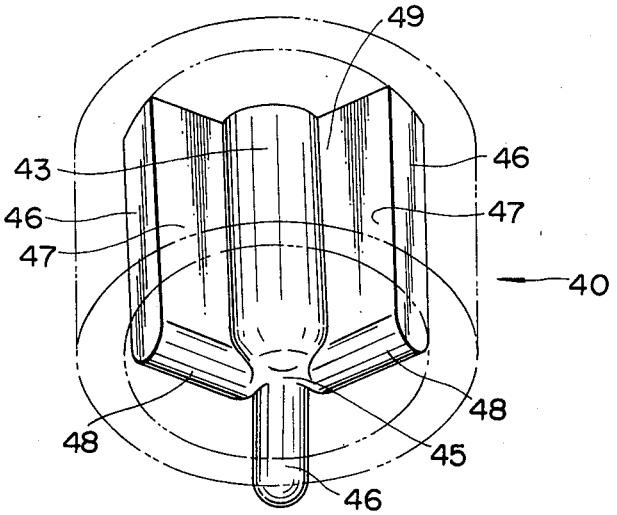
FIG. 8 shows the interior configuration of the upper die of FIG. 7 in a perspective view.

FIG. 5 shows a closed chamber extrusion apparatus according to the invention. The principal part of this apparatus consists of a first or lower die 30, a second or upper die 40, a punch 60 and a counterpunch 70. The details of these elements 30, 40, 60 and 70 which cooperate in the manufacture of the tulip-shaped part of FIG. 1 will later be described. The lower die 30 is generally cylindrical and is shrink-fitted in a shrinkage ring 32 which is fixedly mounted on a bolster plate 54 of a forging press machine (not illustrated). The upper die 40 is shrink-fitted in a shrinkage ring 42 which is fixed to an upper bolster plate 56 attached to a main ram (not shown) of the press machine such that the two dies 30 and 40 have a common vertical axis L. In the center of the lower die 30, there is a cylindrical guide hole 33 into which the punch 60 can be inserted from the bottom side of the die 30. The upper die 40 is formed with three vertical apertures (as shown in FIGS. 7 and 8), and three legs 74 (shown in FIG. 10) of the counterpunch 70 can slidably and downwardly be inserted into the three apertures. When the two dies 30 and 40 are coaxially engaged by utilizing recesses 36 in the lower die 30 and mating protuberances 48 of the upper die 40, there is formed a die cavity 50 conjoining the guide hole 33 of the lower die 30 and the aforementioned apertures in the upper die 40. Indicated at P is the parting plane between the engaged two dies 30 and 40. The press machine has a sub-ram (not shown) to thrust the punch 60 and another sub-ram (not shown) to apply a counter load or back pressure on the counterpunch 70. The punch 60 and the counterpunch 70 are connected to respective sub-rams each by a push rod (not shown) and can be moved individually. Indicated at 58 is a compression spring to aid retraction of the counterpunch 70 inserted into the upper die 40.

Figure 6:
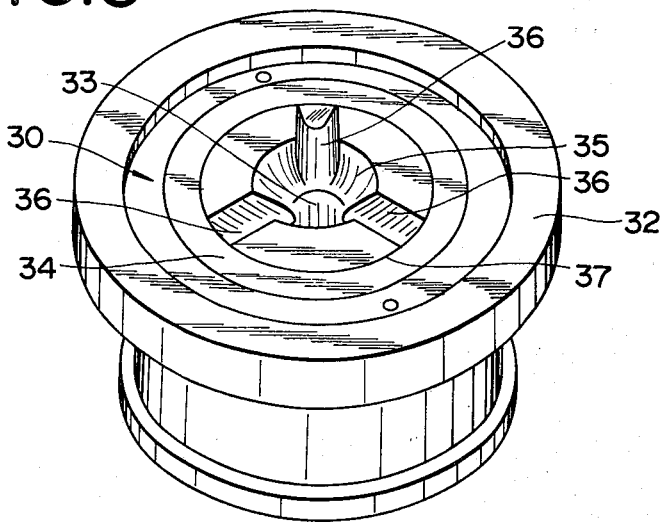

Referring to FIG. 6, the cylindrical guide hole 33 in the lower die 30 diverges in its upper end portion to provide a frustoconical recess 35 in the center of a flat and circular upper end face 34 of this die 30. As a consequence, the initially circular upper end face 34 becomes an annular surface. Furthermore, three radial grooves 36 are formed in the annular surface 34 at equal angular intervals. At the radially outer side, these grooves 36 terminate at a circumference 37 of which the diameter is the maximum outer diameter of the yoke portion 12 of the tulip-shaped part to be manufactured. The grooves 36 extend radially inwardly so as to partially cut off the frustoconical wall face of the recess 35. In a vertical section transverse to the longitudinal axis of each groove 36, each groove is rectangular in an upper region and semicircular at the bottom.

Referring to FIGS. 7 and 8, the upper die 40 has a solid cylinder 43 which extends vertically in the center of this cylindrical die to leave a cross-sectionally annular space around this central cylinder 43. The lower end face 45 of this solid cylinder 43 may be flush with an annular lower end face 44 of the die 40, but preferably is slightly below the annular surface 44. The diameter of the solid cylinder 43 determines the diameter of the cylindrical inner surfaces 23 of the tulip-shaped part of FIG. 1, while the outer diameter of the annular space determines the diameter of the outer cylindrical surfaces 22 of the tulip-shaped part and is equal to the diameter of the circumference 37 in the lower die 30. Furthermore, three walls 46 extend radially from the peripheral surface of the solid cylinder 43 at equal angular intervals such that the space around the cylinder 43 is partitioned into three cross-sectionally sector-like chambers 49. Each of these radial walls 46 has two vertical and parallel surfaces 47. The three walls 46 protrude from the lower end of the upper die 40, and a lower endmost portion 48 of each wall 46 has the shape of a downwardly convex semi-cylinder. The upper die 40 fully engages the lower die 30 when the protruded lower end portions 48 of the three walls fit respectively into the three grooves 36 in the lower die 30 until the lower end face 44 of the upper die comes into close contact with the upper face 34 of the lower die 30. The thickness of each radial wall 46 given by the distance between the two parallel surfaces 47 of each wall 46 determines the horizontal width of each slot-like gap 29 of the tulip-shaped part. The lower end face 45 of the central cylinder 43 is formed with a suitable impression to cause cleavage of a cylindrical metal rod inserted into the guide hole 33 in the lower die 30 and axially pressed against this end face 45 into three identically and equiangularly branched portions. The radially inner portions of the semi-cylindrical portions 48 of the radial walls 46 are connected to the impression of the central end face 45 by curved surfaces.

Figure 9:
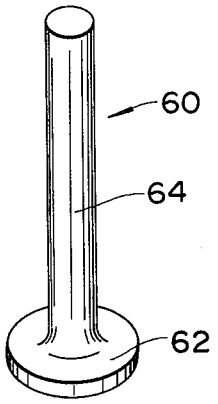
FIG. 9 is a perspective view of a punch for use in combination with the lower die of FIG. 6.

As shown in FIG. 9, the punch 60 is principally a simple solid cylinder 64 slidably fitting into the cylindrical guide hole 33 in the lower die 30. At one end, the punch 60 has a flange 62 with which the above-mentioned push rod of the press machine comes into contact.

Figure 10:
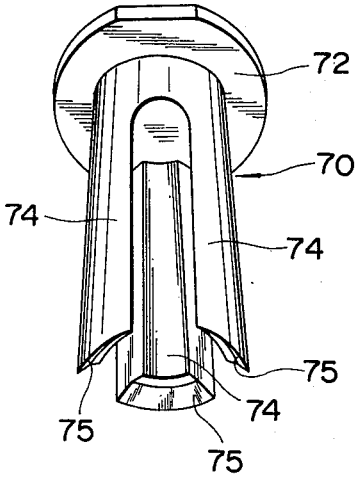
FIG. 10 is a perspective view of a counterpunch for use in combination with the upper die of FIG. 7.

FIG. 10 shows the details of the counterpunch 70. The upper end of the counterpunch 70 is shaped as a flange 72 to contact a push rod of the press machine, and three legs 74 extend from the flange 72 vertically downwards. These legs 74 are arranged circumferentially and spaced at equal intervals of 120° in conformance with the three chambers 49 in the upper die 40. The dimensions and cross-sectional shape of the legs 74 are such that the three legs 74 fit slidably into the three chambers 49, respectively. On the radially inner side, the lower end of each leg 74 is chamfered so as to have a frustoconical surface 75 to form the frustoconical surface 28 of each arm 20 of the tulip-shaped metal part of FIG. 1. The counterpunch 70 is made to have a length sufficient for knock-out of the shaped metal part from the disengaged upper die 40.

As to the material for the lower and upper dies 30, 40, punch 60 and counterpunch 70, it is desirable to use a tool steel high in toughness and hardness such as a high speed tool steel containing chromium, molybdenum, tungsten and vanadium.

EXAMPLE

A tulip-shaped metal part of the configuration of FIGS. 1–4 was manufactured in the following way by using the apparatus as illustrated in FIGS. 5–10. The major dimensions of the tulip-shaped part were as follows.

Total length: 80 mm
Outer diameter of the yoke portion: 63.5 mm
Length of each arm (H in FIG. 4): 35 mm
Width of each arm (W in FIG. 2): 38 mm The material was a chromium-molybdenum case hardening steel formed into the shape of a cylindrical rod 23 mm in diameter and 115 mm in length.

(1) The main ram of the forging press machine was moved to an upper extreme position to pull up the upper die 40 and part it from the lower die 30.

(2) The steel rod used as the material was preheated to 750°–850° C. and inserted into the guide hole 33 in the lower die 30 to protrude into the frustoconical recess 35.

Figure 11A:
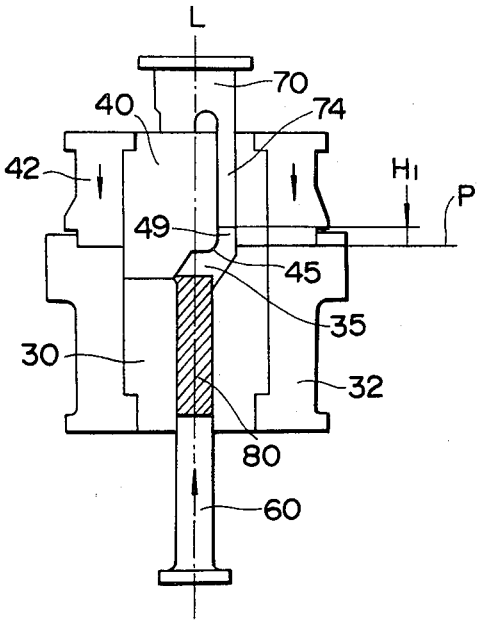
FIGS. 11(A) to 11(C) illustrate a process of shaping a cylindrical rod into the tulip-shaped part of FIG. 1 by a method according to the invention using the apparatus of FIG. 5.

(3) The upper die 40 was lowered to engage the lower die 30, and pressed against the lower die 30 by the application of a load of about 350 tons to firmly clamp the engaged dies 30, 40. As shown in FIG. 11(A), at this stage the punch 60 and the counterpunch 70 were maintained stationary respectively in the predetermined positions. The distance $H_1$ of the lower end of the counterpunch 80 from the parting plane P was 18 mm. The above-mentioned steel rod is indicated by numeral 80.

(4) The lower sub-ram of the press machine was moved upwards to axially thrust up the punch 60, so that the upper end of the steel rod 80 was forced against the impression formed on the end face 45 in the center of the upper die 40. The load applied to the punch 60 was about 160 tons. As the punch 60 was continuously forced to move upwards, the steel rod 80 began to longitudinally cleave into three equiangularly branched portions, which extended obliquely outwardly with respect to the center axis L of the apparatus and intruded into the three cross-sectionally sector-like chambers 49 defined in the upper die 40.

Figure 11B:
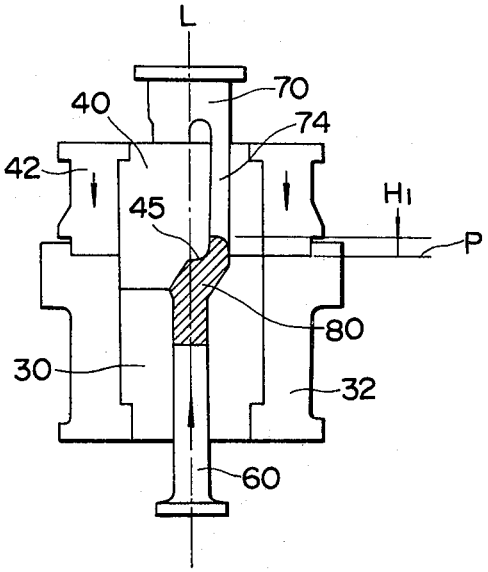
Figure 12A:
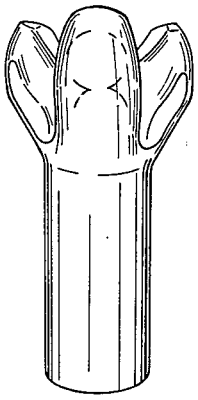
FIGS. 12(A) to 12(F) illustrate the process of deformation of a cylindrical rod into the tulip-shaped part of FIG. 1 during one cycle of a closed chamber extrusion operation according to the invention.
Figure 12B:
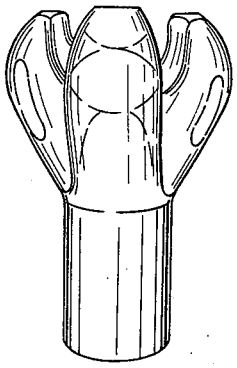
Figure 12C:
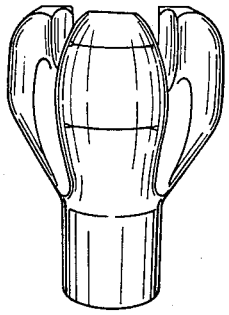
Figure 12D:
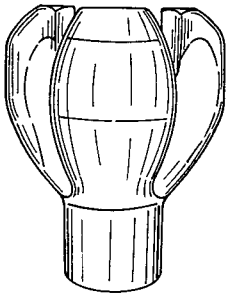
Figure 12E:
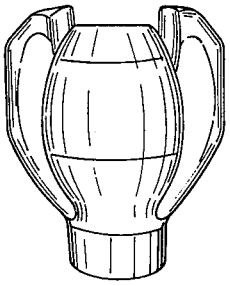
Figure 12F:
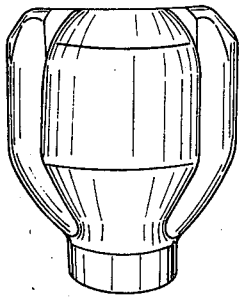

(5) A load of about 80 tons was applied to the counterpunch 70 to exert a back pressure on the material 80 moving upwards in the chambers 49, as illustrated in FIG. 11(B). At the stage of FIG. 11(B), the partially cleaved steel rod 80 in the dies 30, 40 had become as illustrated in FIG. 12(B) having passed through the state as shown in FIG. 12(A).

Figure 11C:
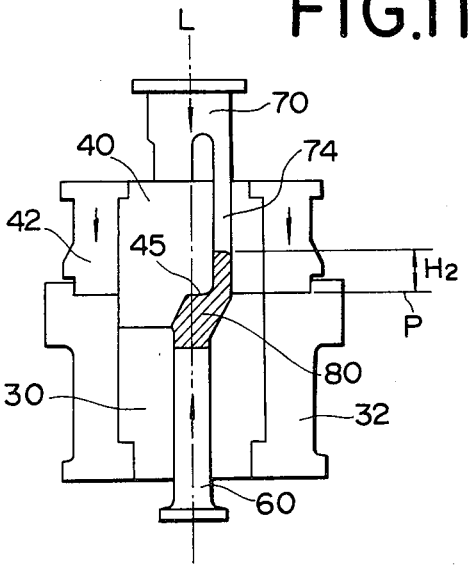

(6) Maintaining the load on the counterpunch 70, the punch 60 was further forced upwards and simultaneously the counterpunch 70 was gradually moved upwards to allow upward extrusion of the material 80, which occupied the entire volume of the space in the dies 30, 40, within the three chambers 49 extending parallel to the axis L. Referring to FIG. 11(C), the extrusion operation was completed when the lower end of the counterpunch 70, and hence the upper ends of the branched and extruded portions of the material, reached a predetermined level represented by the distance $H_2$ of the lower end of the counterpunch 70 from the parting plane P. In this example, the distance $H_2$ was about 35 mm.

During the extrusion operation with the application of back pressure, the material 80 in the dies 30, 40 changed its configuration in the way illustrated by FIGS. 12(B) to 12(F).

(7) The punch 60 and the counterpunch 70 were released from the loads, and the upper die 40 was parted from the lower die 30 by upwardly moving the main ram of the press machine. Then the counterpunch 70 was lowered to accomplish knock-out of the tulip-shaped metal part shown in FIG. 12(F) from the upper die 40. The entire process from the insertion of the steel rod 80 into the lower die 30 to the knock-out of the tulip-shaped part was completed in about 10 seconds.

In the extrusion method according to the invention, the axial extrusion of the material 80 in the three chambers 49 is performed with continued exertion of a back pressure on the extruding material 80. This is very important to allow the material to sufficiently and uniformly expand laterally, and also to prevent the occurrence of under-filling in the upper end corner regions of the petal-like arms 20.

As described hereinbefore, the two vertical surfaces 47 of each radial wall 46 in the upper die 40 are made flat and parallel to each other, and the lower end of the counterpunch 70 is chamfered to have frustoconical surfaces 75. Jointly, these two factors are quite effective for obtaining tulip-shaped metal parts free of burrs, cracks and flaws.

Figure 13:
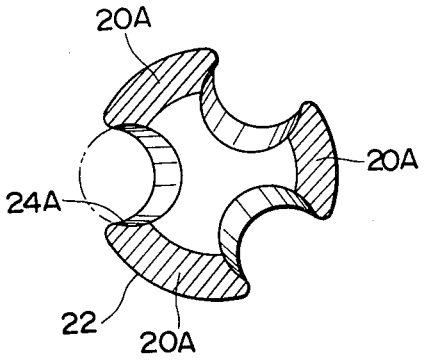
FIG. 13 is a cross-sectional view of a tulip-shaped part resembling the part of FIG. 1 but manufactured by a method not in accordance with the invention.
Figure 14:
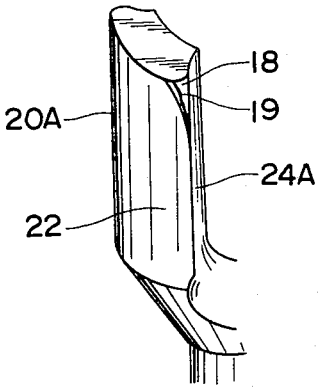
FIG. 14 is a perspective view of a petal-like arm of the tulip-shaped part of FIG. 13.

When, for example, the vertical surfaces 47 of the three walls 46 are made cylindrical to give a tulip-shaped metal part, as shown in FIG. 13, whose petal-like arms 20A have cylindrical side surfaces 24A, frequently there appears a burr or crack 19 as shown in FIG. 14 in upper end corner regions of each arm 20A. Also, FIG. 14 illustrates the occurrence of under-filling indicated at 18 in the same regions of the arm 20A in the case of using a counterpunch having a flat end face.

Figure 15:
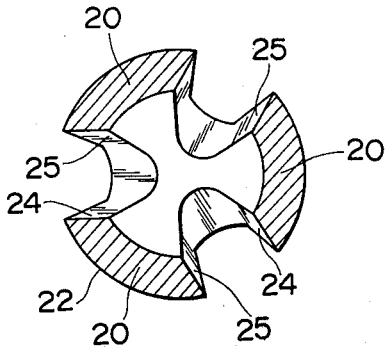
FIG. 15 is a cross-sectional view of the tulip-shaped part of FIG. 1.
Figure 16:
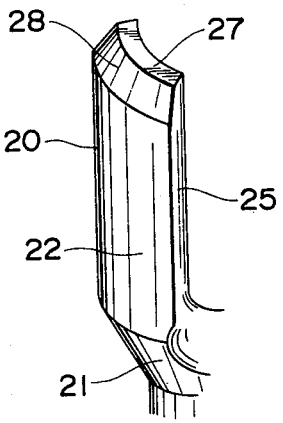
FIG. 16 is a perspective view of an arm of the part of FIG. 1.

In contrast, the arms 20 of a tulip-shaped metal part manufactured by the herein illustrated method and apparatus has a cross-sectional configuration as shown in FIG. 15. That is, each arm 20 has flat side surfaces 24 and 25, and the left-hand side surface 24 of each arm 20 is parallel to the right-hand side surface 25 of the adjacent arm 20. In this case, lateral expansion of the material under extrusion in the chambers 49 occurs smoothly even in a region to become the edge between the side surface 24, 25 and the other cylindrical surfaces 22. As a consequence, each arm 20 can be shaped without the occurrence of burrs or cracks, as illustrated in FIG. 16. Also illustrated in FIG. 16 is a complete form of the upper end corner of the arm 20 which is produced by the tapered end face of the counterpunch 70 for prevention of under-filling.

Figure 18:
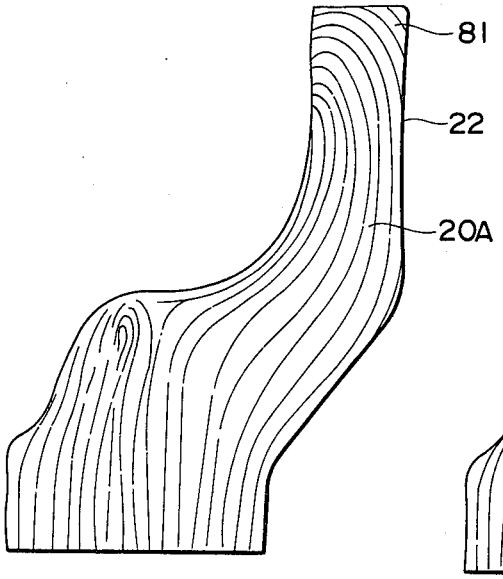
FIG. 18 illustrates the flow of metal in an arm portion of a tulip-shaped part slightly different in design from the part of FIG. 1.
Figure 17:
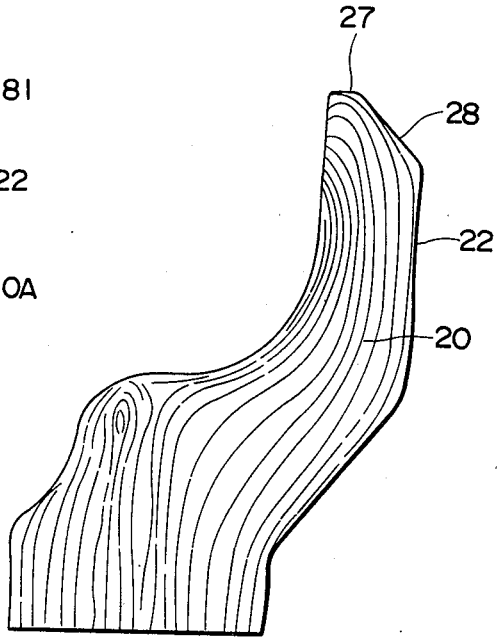
FIG. 17 illustrates the flow of metal in an arm portion of the tulip-shaped part of FIG. 1.

FIG. 17 illustrates the manner of flow of the metal material during extrusion shaping of the tulip-shaped part of FIGS. 15 and 16, and FIG. 18 illustrates the material flow for the tulip-shaped part of FIGS. 13 and 14. In the case of FIG. 17, the tapered surface 28 between the cylindrical surface 22 and the upper end face 27 allows the metal to flow under little restriction even in the both axially and radially extreme region, but in the case of FIG. 18, the flow of the metal in a corner region indicated at 81 is significantly restricted. The difficulty of accomplishing a smooth and free flow of the metal in this region 81 is the primary reason for the appearance of burrs and cracks 19 as illustrated in FIG. 14. As an additional merit of forming the tapered surface 28 during the extrusion process, it becomes unnecessary to subject the extrusion-shaped part to a machining operation for the purpose of chamfering.

What is claimed is:

1. A method of manufacturing a tulip-shaped metal part having three outwardly extending petal-like arms which are spaced apart at equal angular intervals and which extend from one end of a solid cylinder obliquely outwardly with respect to the longitudinal axis of the solid cylinder in their root portion and parallel to said longitudinal axis in the remaining portion, the method comprising the steps of:

inserting a solid cylindrical rod of a forgeable metal material into a guide hole formed in a first of two opposingly engaged dies and pushing said rod so that said rod longitudinally protrudes into a central space defined in said engaged dies until one end of said rod collides against an impression formed on an end face surface in said second die;

exerting a compression force on the other end of said rod to axially press said rod against said impression to cause said rod to gradually and continuously cleave longitudinally into three branched portions which extend obliquely outwardly with respect to said axis of said rod and which are spaced apart circumferentially at equal angular intervals;

continuing the exertion of the compression force on the other end of said partially cleaved rod in the axial direction to extrude said three branched portions respectively into three chambers which are arranged in said second die in a circumferential arrangement at equal angular intervals and which conjoin said central space, each of said three chambers extending parallel to the longitudinal axis of said guide hole and conforming in cross-sectional shape to the axially extending region of each arm of the tulip-shaped metal part to be manufactured;

inserting a counterpunch having three circumferentially spaced elongate legs, which conform in cross-sectional shape to said three chambers, into said three chambers before intrusion of said three branched portions of the metal material into said three chambers, and maintaining the inserted counterpunch in a predetermined position;

applying back pressure to said counterpunch which is maintained in said position and further continuing the exertion of the axial compression force on the other end of said partially cleaved rod until the cleaved and deformed metal material completely fills said central space and said three chambers in said engaged dies and comes into contact with the inserted ends of said respective legs of said counterpunch; and further continuing the exertion of the axial compression force on said partially cleaved rod while further continuing the application of back pressure to said counterpunch to further extrude the metal material into said three chambers and force said counterpunch to gradually retract from said position against the back pressure until the extruded metal material in said three chambers reaches a predetermined length.

2. A method according to claim 1, further comprising the step of preheating said rod of said metal material before insertion of said rod into said guide hole.

3. A method according to claim 1 or 2, wherein said central space has a generally frustoconical shape coaxially converging to an inner end of said guide hole, each of said three chambers being laterally defined by two cylindrical surfaces concentric and coaxial with said axis of said guide hole and two flat end surfaces which are parallel to said axis of said guide hole and which obliquely intersect said two cylindrical surfaces.

4. A method according to claim 3, wherein each of said legs of said counterpunch has a generally frustoconically tapered surface such that each said arm of the tulip-shaped metal part has a generally frustoconical surface as a tip region of the radially outer surface thereof.

5. A apparatus for manufacturing a tulip-shaped metal part having three outwardly extending petal-like arms which are spaced apart at equal angular intervals and which extend from one end of a solid cylinder obliquely outwardly with respect to the longitudinal axis of the solid cylinder in their root portion and parallel to said longitudinal axis in the remaining portion, the apparatus comprising:

a first die having a recess formed in one end surface and having a cylindrical guide hole extending from the opposite end surface to open into said recess;

a second die which is opposingly engageable with said first die, said second die having a solid cylindrical central part coaxial with said guide hole in said first die and having three walls radially extending from the periphery of said cylindrical central part at equal angular intervals and parallel to the longitudinal axis of said central part to partition a cross-sectionally annular through-hole formed around said central part into three chambers each of which conforms in cross-sectional shape to each arm of the tulip-shaped metal part to be manufactured, an end face of said central part which is opposed to said first die being formed with an impression such that, when one end of a solid cylindrical metal rod inserted into said guide hole of said first die is pressed against said end face, the metal rod is longitudinally cleaved into three branched portions which extend respectively into said three chambers; and a counterpunch having three elongate legs corresponding in arrangement and cross-sectional shape to said three chambers in said second die, said legs slidably fitting into said three chambers.

6. An apparatus according to claim 5, wherein each of said three walls in said second die has two flat and parallel surfaces which are parallel to the longitudinal axis of said cylindrical central part and which obliquely intersect two concentrical walls defining said annular through-hole.

7. An apparatus according to claim 6, wherein said recess in said first die is generally frustoconical and coaxial with said guide hole and becomes largest in diameter at said one end face of the first die, the diameter of said cylindrical central part of said second die being smaller than the largest diameter of said recess.

8. An apparatus according to claim 7, wherein each of said three legs of said counterpunch has a tapered end face such that, when said legs are respectively fitted into said three chambers in said second die, the length of said three chambers becomes smallest on the radially outer periphery of said chambers.

9. An apparatus according to claim 8, wherein said one end face of said first die is formed with three grooves extending radially from said recess and in conformance with said three walls in said second die, said three walls having endmost portions which protrude from said cross-sectionally annular through-hole and are shaped such that, when said first and second dies are engaged, said endmost portions fit into said three grooves, respectively.

* * * * *